United States Patent [19]

Gudas

[11] Patent Number: 4,677,766

[45] Date of Patent: Jul. 7, 1987

[54] SHOE INLAY

[75] Inventor: Charles J. Gudas, Lockport, Ill.

[73] Assignee: Scholl, Inc., Memphis, Tenn.

[21] Appl. No.: 402,652

[22] Filed: Jul. 28, 1982

[51] Int. Cl.[4] ..... A43B 13/38

[52] U.S. Cl. ..... 36/43; 36/44

[58] Field of Search ..... 36/43, 44, 88, 93, 102, 36/71, 30 R; 128/585, 615, 617, 619, 621, 622

[56] References Cited

U.S. PATENT DOCUMENTS

| | | | |
|---|---|---|---|
| 1,890,910 | 12/1932 | Marshall | 36/44 |
| 2,260,377 | 10/1941 | Herbst | 36/71 |
| 2,680,919 | 6/1954 | Riggs | 128/617 |
| 3,253,600 | 5/1966 | Scholl | 128/582 |
| 3,253,601 | 5/1966 | Scholl | 125/594 |
| 4,055,699 | 10/1977 | Hsiung | 36/44 |
| 4,124,946 | 11/1978 | Tomlin | 36/43 |
| 4,128,950 | 12/1978 | Bowerman et al. | 36/44 |
| 4,268,980 | 5/1981 | Gudas | 36/43 |

FOREIGN PATENT DOCUMENTS

| | | | |
|---|---|---|---|
| 671491 | 1/1939 | Fed. Rep. of Germany | 36/71 |

*Primary Examiner*—Werner H. Schroeder
*Assistant Examiner*—Steven N. Meyers
*Attorney, Agent, or Firm*—Gerald S. Rosen; Warrick E. Lee, Jr.; Stephen I. Miller

[57] ABSTRACT

A full shoe inlay for athletic shoes constructed of resilient material having a depression for the 1st metatarsal head, a raised portion for the 2nd, 3rd, and 4th metatarsal heads, a full arch support, and an eccentric heel seat. The heel seat is built up more on the inside than on the outside. The inlay prevents or lessens a number of common athletic-related injuries.

6 Claims, 18 Drawing Figures

C

B

A

I

H

G

L

K

J

O

N

M

SHOE INLAY

This invention relates to inlays for shoes, especially for athletic shoes used by participants in sporting events, such as running, tennis, basketball, etc.

Some prior art inlays are designed to prevent various problems that occur during athletic events. For example, U.S. Pat. No. 4,268,980 discloses a device designed to detorque the heel. Other prior art devices are designed to cushion the impact of the ground against the foot and/or to support the medial longitudinal arch of the foot. The present invention is specifically designed to help prevent or reduce overpronation, i.e. excessive bending of various foot member in relation to each other. In addition, this invention provides firmer arch support than many prior-art devices and excellent cushioning.

The unique combination of features incorporated into the present invention prevents or lessens the severity of a surprisingly high number of common athletic-related injuries, including:

1. Knee injuries, sucn as tendonitis, lateral knee pain, true chondromalacia, and posterior knee pain,
2. Toe-jamming black toenail,
3. Tibial tendonitis,
4. Achilles tendonitis,
5. Ankle sprains,
6. Shin splints,
7. Heel pain,
8. Muscle fatigue and strain,
9. Metatarsal pain metatarsalgia,
10. Burning and pain on the ball of the foot,
11. Blisters,
12. Shock related injuries,
13. Heel spurs,
14. Groin and hip injuries, and
15. Fracture of bones of the lower extremities.

The present invention may be summarized by:

A shaped, resilient inlay for footwear comprising:

(a) a bottom surface shaped to fit the top of a sole of a shoe, (b) a contoured top surface to support a foot having:

(1) a toe section, (2) a depression for the first metatarsal head behind said toe section, (3) a raised portion for the 2nd, 3rd 4th, and 5th metatarsal heads adjacent to and outside of said depression, (4) a support behind said depression for the medial longitudinal arch, said support being higher than said raised portion continuously curving downward from the inside toward the outside and being completely filled with resilient material from said bottom surface to the top of said support, and (5) a concave seat behind said support for receiving the heel, said seat being eccentric about the inlay's longitudinal axis such that said seat is built up higher on the inside than on the outside, (c) said inlay being shaped to cover the top surface of a shoe sole from the shoe's toe section to its heel section.

DETAILED DESCRIPTION OF THE INVENTION

Figure 1:
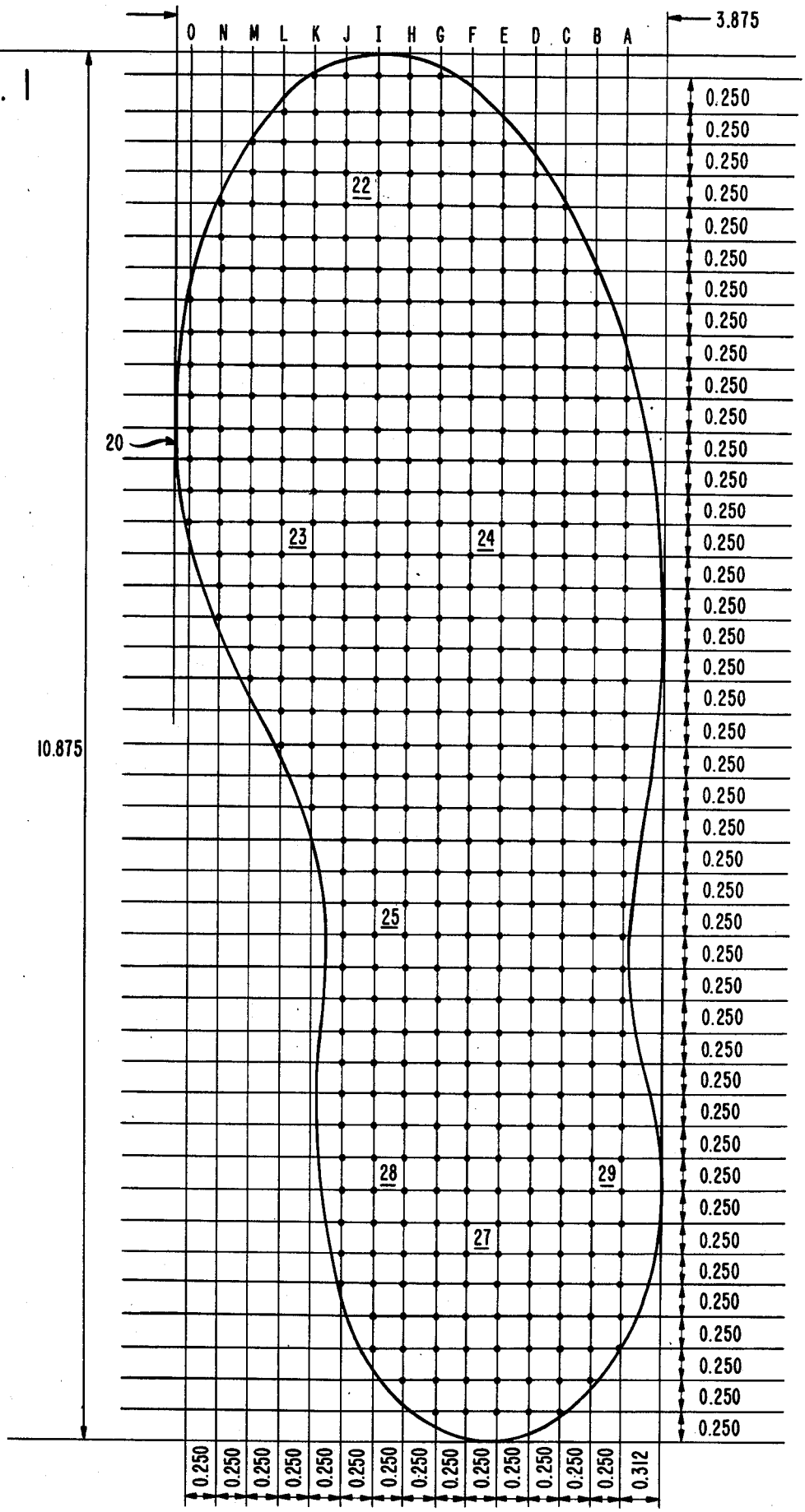
FIG. 1 is a plan view of an insole in accordance with the invention.
Figure 4:
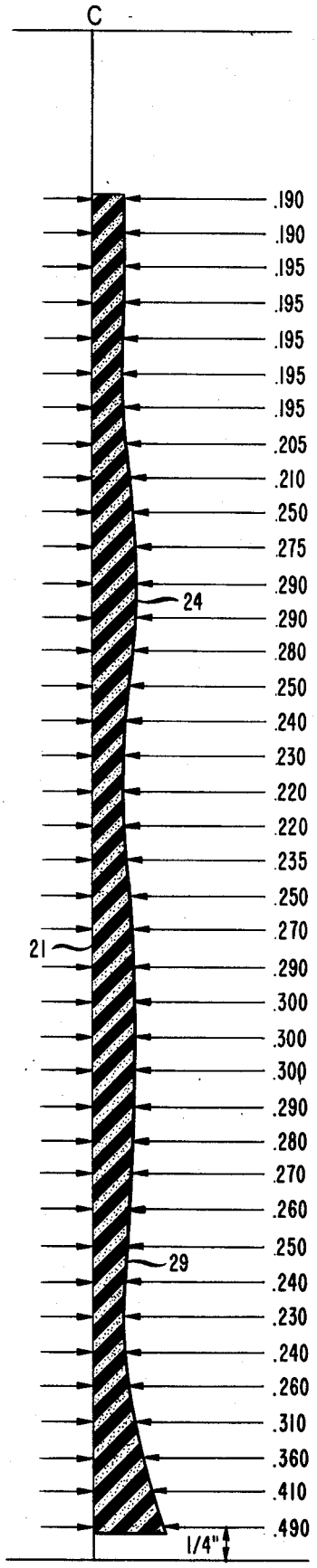
FIGS. 2 through 16 are sectional views along lines A—A through O—O respectively of FIG. 1.
Figure 3:
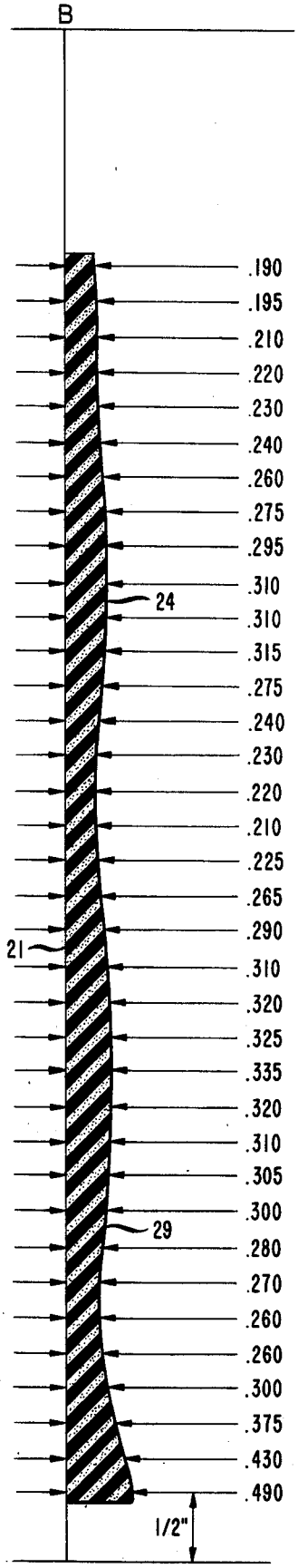
Figure 2:
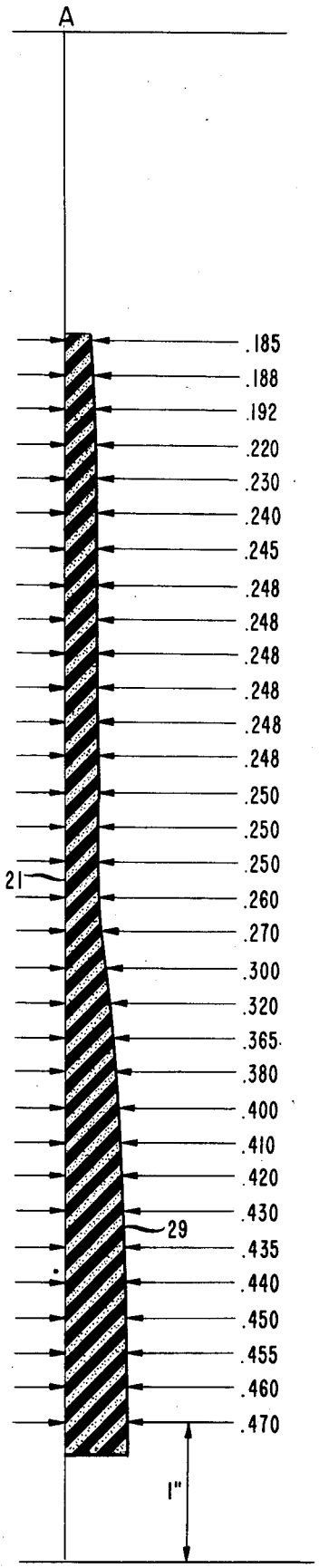

FIG. 1 illustrates a top view of an inlay 20 in accordance with the invention intended to fit into a right shoe. Of course it is best to provide two such inlays that are mirror images of each other, i.e. one for the right shoe and one for the left shoe. FIG. 1 is divided into 15 sections, A—A through O—O, spaced $\frac{1}{4}''$ apart. Each section appears separately in FIGS. 2 through 16. Parallel lines spaced $\frac{1}{4}''$ apart perpendicular to section lines A—A through O—O are superimposed on FIG. 1 forming a grid of $\frac{1}{4}''$ squares. FIGS. 2 through 16 show the thickness of the insole at various points on the grid. All dimensions are in inches.

Figure 13:
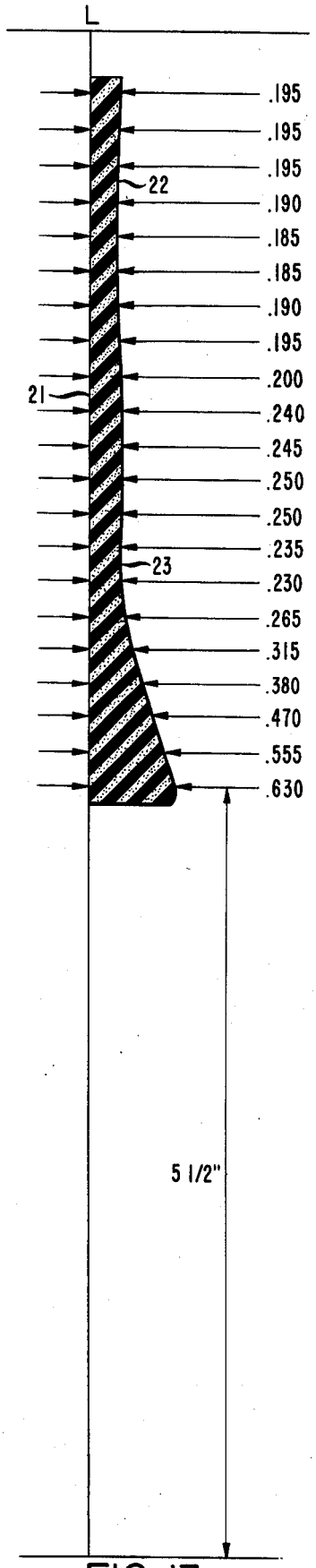
Figure 12:
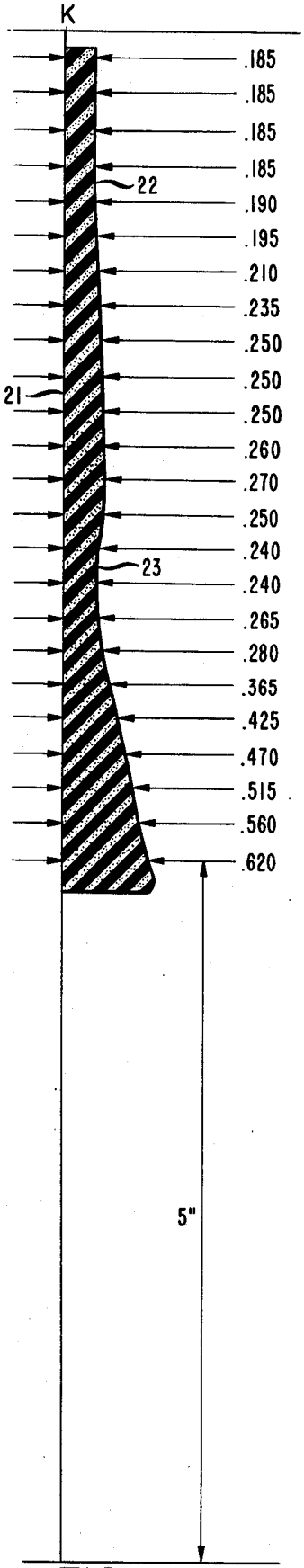
Figure 11:
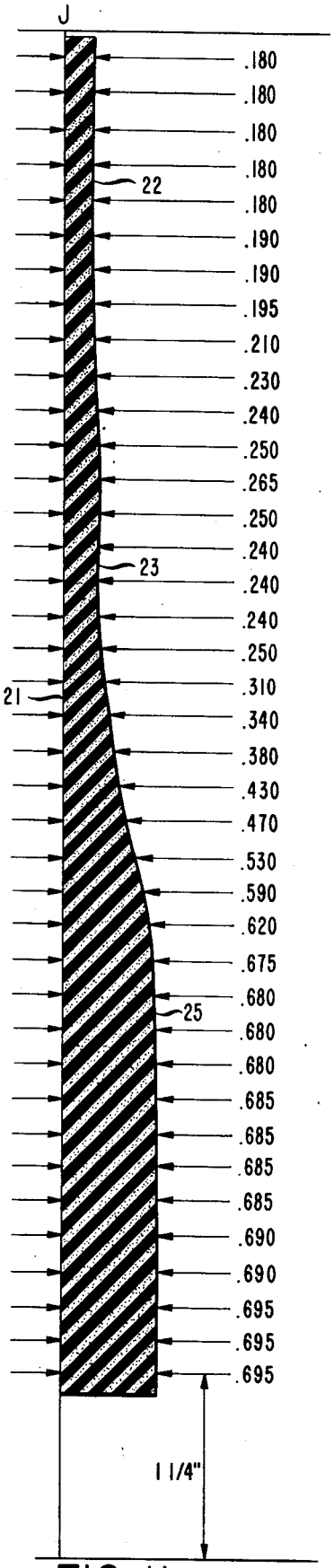
Figure 16:
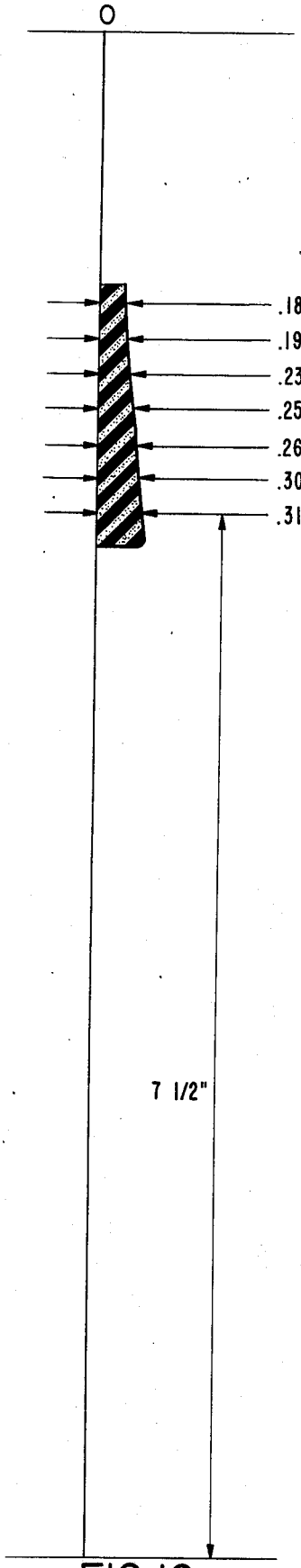
Figure 15:
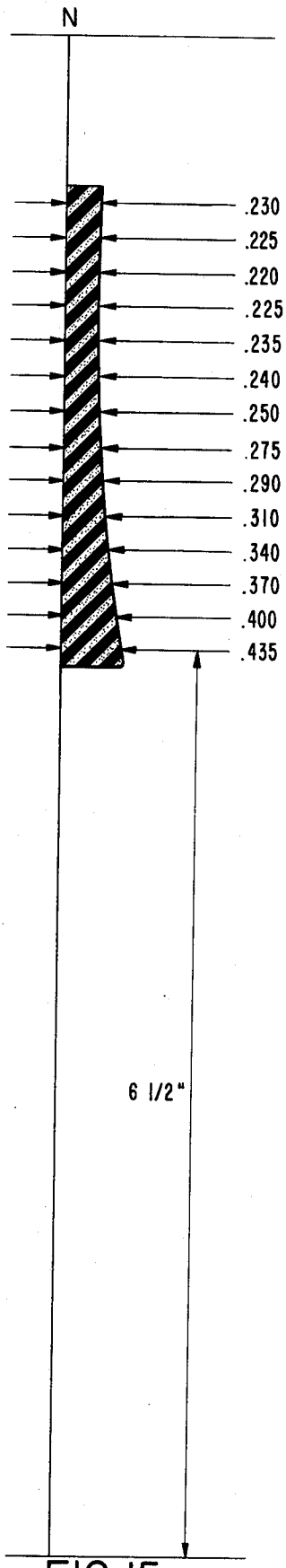
Figure 14:
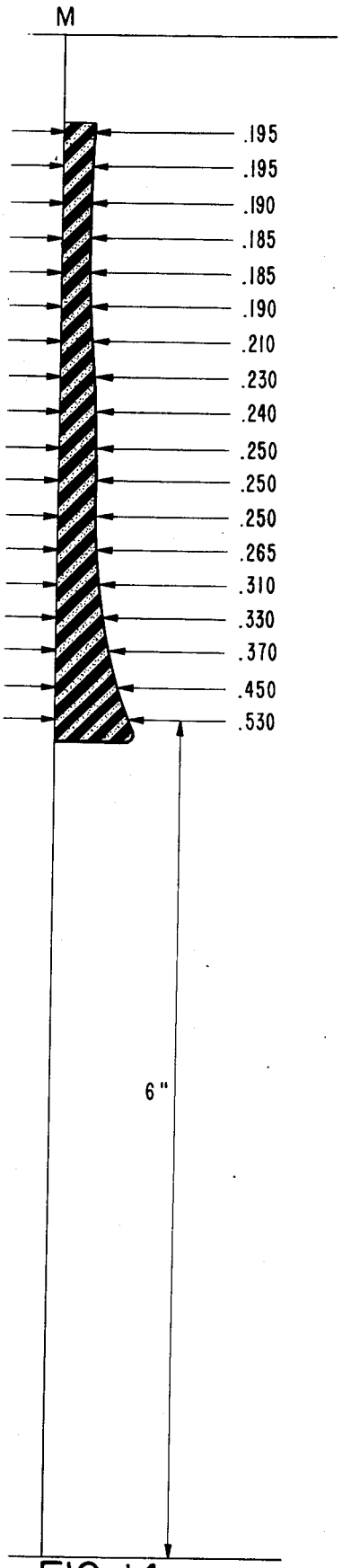

The inlay, which is formed of a resilient material, has a bottom surface 21 shaped to fit the top of a sole of a shoe. Preferably bottom surface 21 is flat. Minor variations in shape of the top of the shoe's sole that abuts surface 21 are of no consequence. However, shoes that already contain a contoured insole, arch support, or other contoured insert should have the contoured insert removed before the inlay of the present invention is installed. The inlay of the present invention is a full inlay shaped to cover the top surface of a shoe sole from the sole's toe section to its heel section. The top surface of the inlay has a toe section 22. Behind the toe section is a depression 23 for the first metatarsal head, commonly called the ball of the foot. Depression 23 is best seen in FIGS. 11, 12, and 13.

Adjacent to and outside of depression 23 there is a raised portion 24 for the 2nd, 3rd, 4th and 5th metatarsal heads, best seen in FIGS. 3 through 9. Raised portion 24 and depression 23 are preferably adapted so that the angle formed by the 1st, 2nd and 5th metatarsal heads is about 142.5°.

Figure 18:
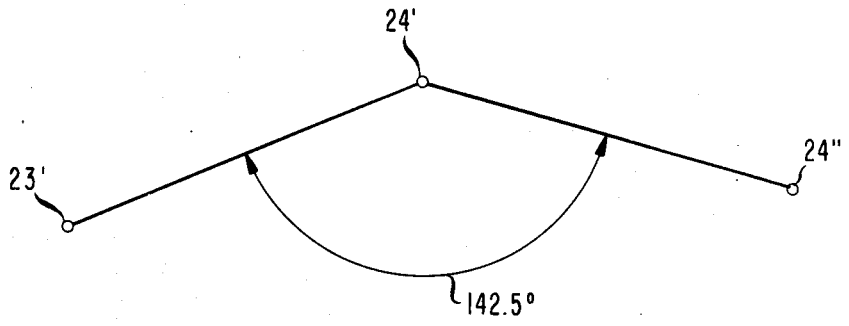
FIG. 18 is a schematic view showing the angular relationship between the points on the insole that support the first, second, and fifth metatarsal heads.

This is best illustrated in FIG. 18, where 23' is the bottom of depression 23, 24' is the point on raised portion 24 that supports the 2nd and metatarsal head, and 24'' is the point on raised portion 24 that supports the 5th metatarsal head. Points 23', 24', and 24'' form an angle of 142.5° as shown in FIG. 18.

Behind depression 23 there is a support 25 for the medial longitudinal arch, best seen in FIGS. 8 through 11. At its highest point support 25 is higher than raised portion 24. Moreover support 25 curves continuously downward from the inside of the inlay toward the outside and is completely filled with resilient material from bottom surface 21 to the top surface of support 25. Preferably the entire inlay is filled with resilient material from bottom surface 21 to its contoured top surface.

Figure 7:
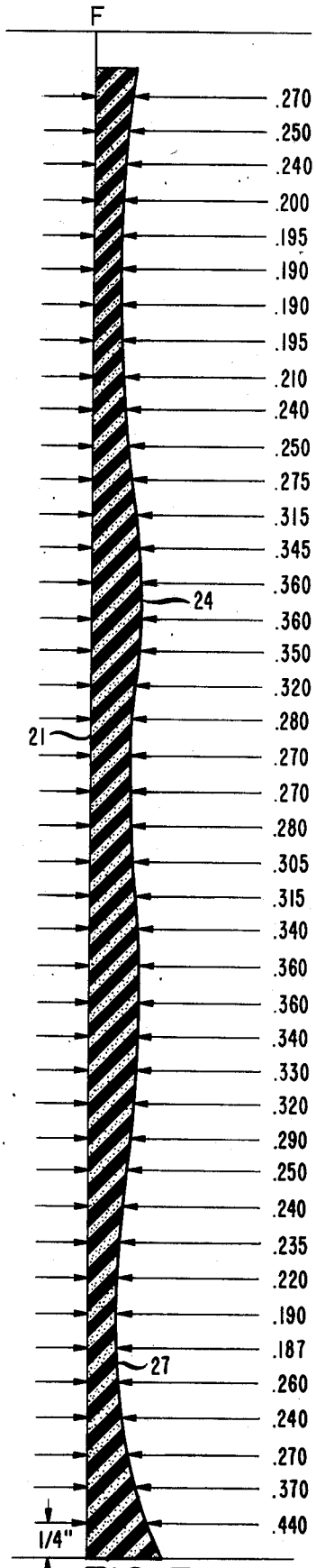
Figure 6:
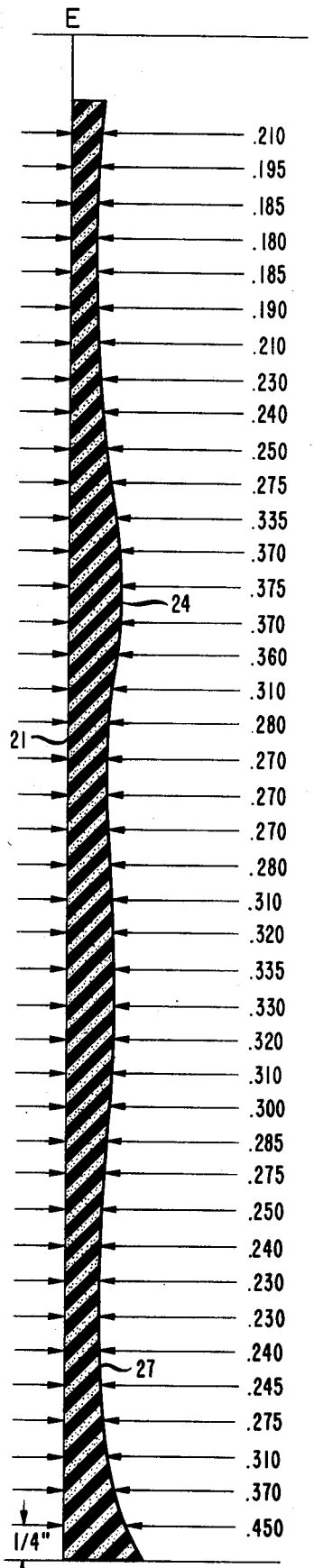
Figure 5:
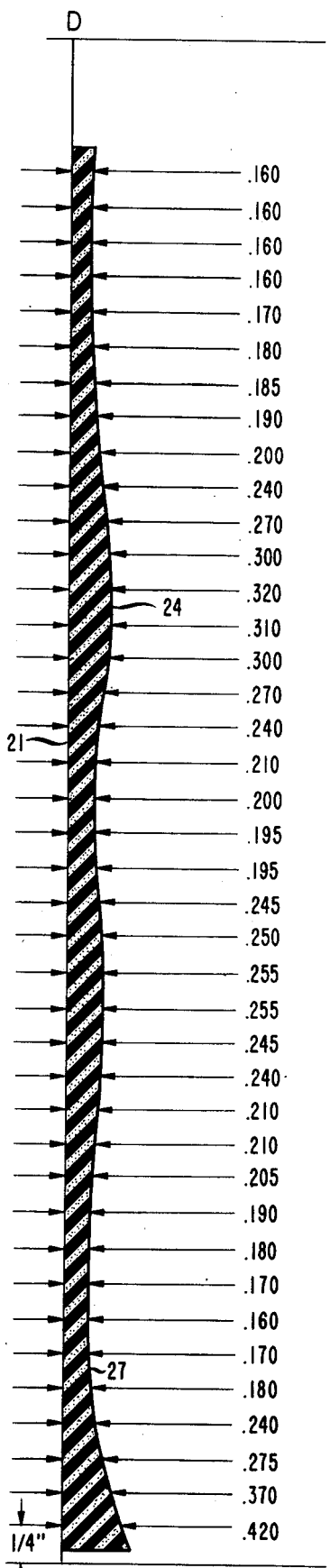
Figure 10:
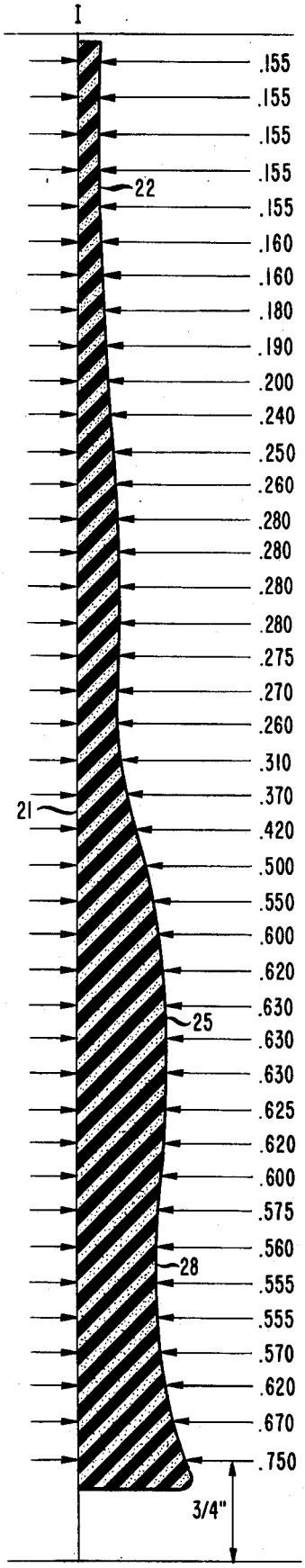
Figure 9:
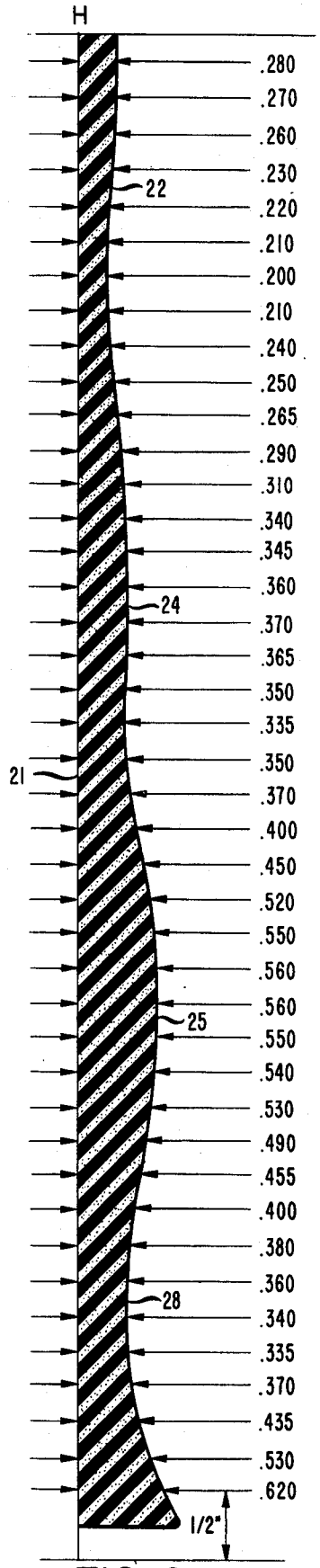
Figure 8:
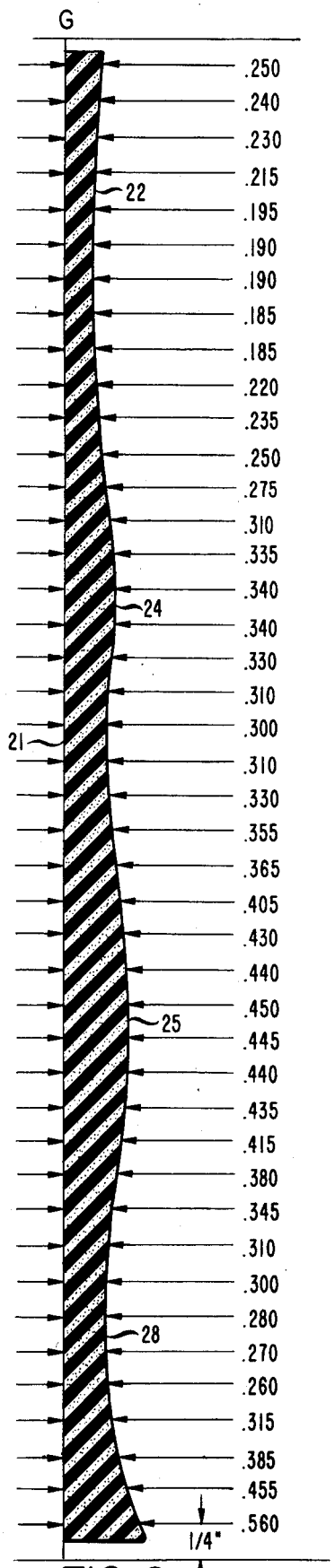

Another key feature of the present invention is as eccentric heel seat 27 behind support 25. Heel seat 27 is concave, as seen in FIG. 5, 6, and 7. The seat is eccentric about the inlays longitudinal axis such that the seat is built up higher on the inside (see element 28 of FIGS. 9 and 10) than on the outside (see element 29 of FIGS. 2, 3, and 4).

For an inlay designed to fit into shoes having American shoe sizes 8 or 9, it is preferred that the inlay have the dimensions shown in FIGS. 1 through 16. For larger or smaller sizes the dimensions should be proportional to those shown in the figures. For shoe sizes 10 and 11, the dimensions should be about 1.06 times those of the figures. For shoe sizes 6 or 7, divide the dimensions of the figures by about 1.06.

An especially preferred design of the inlay may be constructed by decreasing the depth dimensions of the inlay by a constant dimension (about 0.095 inches) and bonding a layer of, memory foam, preferably about 3/32" thick, to the top surface. On top of the memory foam a thin layer of absorbant material is bonded. Thus the preferred layered construction will have total depth dimensions approximately the same as those shown in the figures, or proportional thereto for different sizes.

Figure 17:
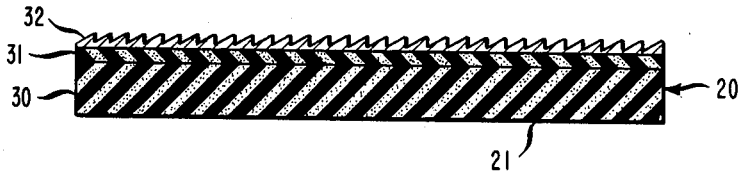
FIG. 17 is a schematic view illustrating a preferred layering of materials for forming the insole of the present invention.

FIG. 17 illustrates the preferred construction. Bottom layer 30 is constructed of a resilient material, preferably closed-cell, cross-linked polyethylene foam. The depths of bottom layer 30 are preferably about 0.095 inches less than those shown in FIGS. 2 to 16. On the contoured top surface of bottom layer 30 there is bonded a layer of high-compressive-strength, polyurethane, open-celled memory foam 31. The polyurethane layer 31 is about 3/32" thick. On top of layer 31 there is bonded a thin layer of an absorbent material 32, such as polyester or cotton terrycloth. Of course, other absorbent materials such as fabrics made of cotton, acetate, etc., and blends are acceptable.

Inlays of the present invention have several advantages. They can extend the life of expensive running shoes. .They can greatly improve the characteristics of moderately priced running shoes. They can prevent or lessen the severity of a surprisingly high number of athletic-related injuries previously listed.

What is claimed is:

1. A shaped, resilient full shoe inlay for athletic footwear comprising:

(a) a bottom surface, (b) a contoured top surface to support a foot having:

(1) a depression for the first metatarsal head, (2) a raised portion for the second, third, fourth and fifth metatarsal heads, (3) a support for the medial longitudinal arch, said support being higher than said raised portion continuously curving downward from the inside of the arch toward the outside of the arch and being completely filled with resilient material from said bottom surface to the top of said support, and (4) a concave seat for receiving the heel, said seat being eccentric about the inlay's longitudinal axis such that said seat it built up higher on the inside of the heel than on the outside of the heel, wherein said inlay has dimensions in accordance with or proportional to those of FIGS. 1 through 16.

2. The inlay of claim 1 wherein the resilient material is closed-cell foam.

3. The inlay of claim 2 wherein said closed-cell form is cross-linked polyethylene.

4. The inlay of claim 3 further comprising a layer of open-celled polyurethane foam attached to said top surface having dimensions in accordance with or proportional to FIG. 1 and dimensions equaling or proportional to those of FIGS. 2 through 16 minus a constant dimension and wherein the thickness of the material on top of the top surface of the cross-linked polyethylene is such that the overall depths of the inlay is in accordance with or proportional to FIGS. 2 through 16.

5. The inlay of claim 4 further comprising a thin layer of absorbent fabric attached to said open-celled foam.

6. The inlay of claim 4 wherein the constant dimension is about 0.095.

* * * * *